United States Patent [19]

Scarinzi

[11] Patent Number: 4,620,798

[45] Date of Patent: Nov. 4, 1986

[54] WATCH CASE

[75] Inventor: Renato Scarinzi, Bienne, Switzerland

[73] Assignee: Montres RADO SA, Lengnau b/Biel, Switzerland

[21] Appl. No.: 678,432

[22] Filed: Dec. 5, 1984

[30] Foreign Application Priority Data

Jan. 26, 1984 [CH] Switzerland ..... 361/84

[51] Int. Cl.[4] ..... G04B 37/00

[52] U.S. Cl. ..... 368/276; 368/294

[58] Field of Search ..... 368/88, 276, 287, 294, 368/296, 299, 300, 309

[56] References Cited

U.S. PATENT DOCUMENTS 4,327,429 4/1982 Flingenberg ..... 368/294
4,397,566 8/1983 Lederrey ..... 368/291
4,437,770 3/1984 Gogniat ..... 368/294
4,440,505 4/1984 Gogniat ..... 368/294
4,529,323 7/1985 Gagnebin ..... 368/291

FOREIGN PATENT DOCUMENTS 0072345 2/1983 European Pat. Off. ..... 368/309

*Primary Examiner*—Vit W. Miska
*Attorney, Agent, or Firm*—Pollock, Vande Sande & Priddy

[57] ABSTRACT

A watch case is described comprising a middle, a front plate and a back. The middle includes two concentric rings, an outer ring and an inner ring, with both being sandwiched between the front plate and the back. The inner ring provides support for the movement and the dial. The outer ring protects the watch and helps to enhance its appearance. The front plate and the outer ring are best made of hard material.

18 Claims, 5 Drawing Figures

WATCH CASE

BACKGROUND OF THE INVENTION

1. Field of the Invention

This invention relates to a watch case of the kind comprising a front plate, a middle and a back.

In watches of this kind, the function of the middle is threefold: to position the movement and the dial, to protect the watch from environmental aggressions and to contribute to the aesthetic appearance of the watch. In addition, with water-resistant watches, at least, the middle serves to help to keep sealing gaskets in place.

In practice, the middle is particularly problematic because of the contradictory requirements of its threefold function: the aesthetic and protective aspects are best satisfied with hard materials, while the positioning aspect requires complex and accurate shapes, best achieved with a material that is machinable by cutting tools, or with an easily injectable plastics material.

2. Prior Art

In some known watch cases, a compromise solution has been to use brass for the middle and to coat the latter with chrome. Unfortunately, with use, the chrome layer soon gets scratched.

In other known watch cases, the middle is protected by a cap made of hard material, e.g. tungsten carbide. Such cases are virtually everlasting but have a rather massive aspect and are nonetheless difficult to produce since the cap involves quite complex shapes.

SUMMARY OF THE INVENTION

An object of the invention is to provide a more satisfactory answer to this problem.

According to the invention there is provided a watch case of the kind set forth wherein the middle includes inner and outer concentric rings sandwiched between the plate and the back, the inner ring being adapted to provide support for a watch movement and the outer ring serving to protect the watch and to contribute to its aesthetic appearance.

BRIEF DESCRIPTION OF THE DRAWINGS

In the accompanying drawings given by way of example.

In the various illustrated embodiments, the same references have been used to designate corresponding parts.

DETAILED DESCRIPTION

Figure 1:
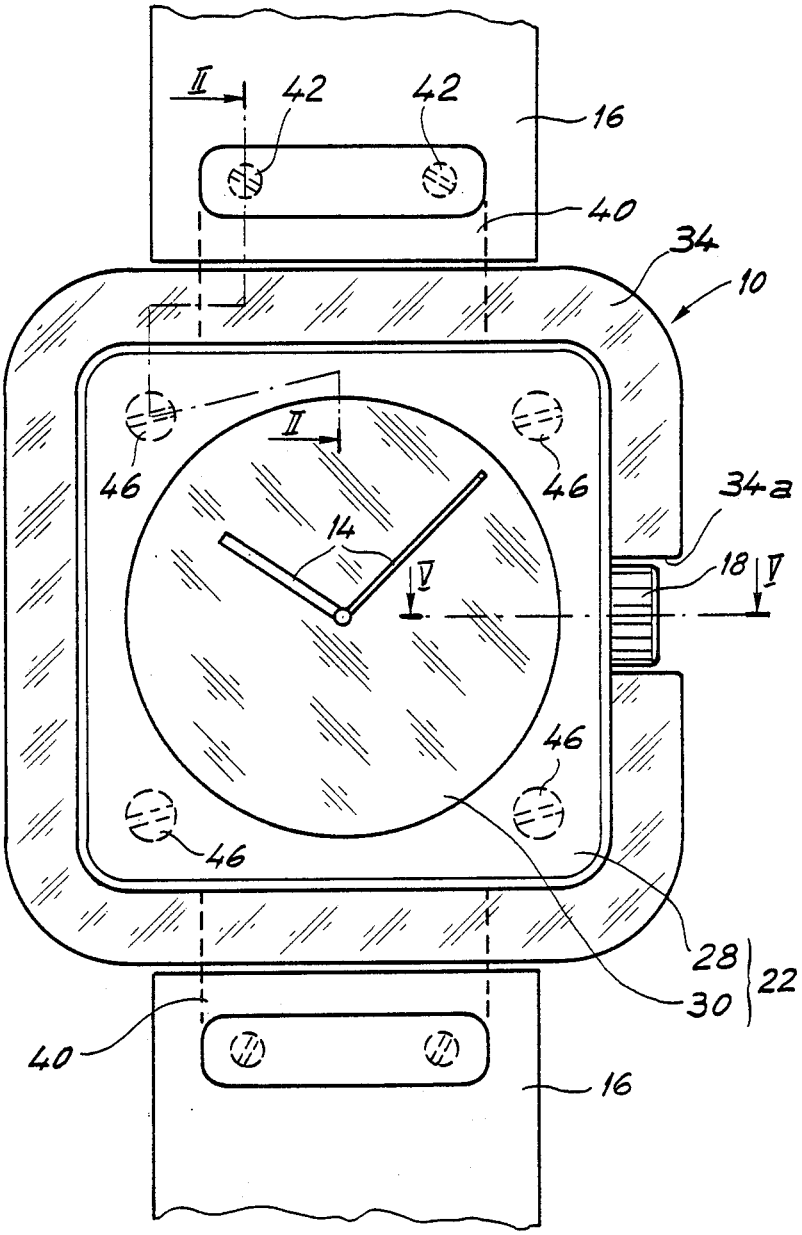
FIGS. 1 and 2 are a plan view and a cross-sectional view of a watch fitted with a case according to the invention.
Figure 2:
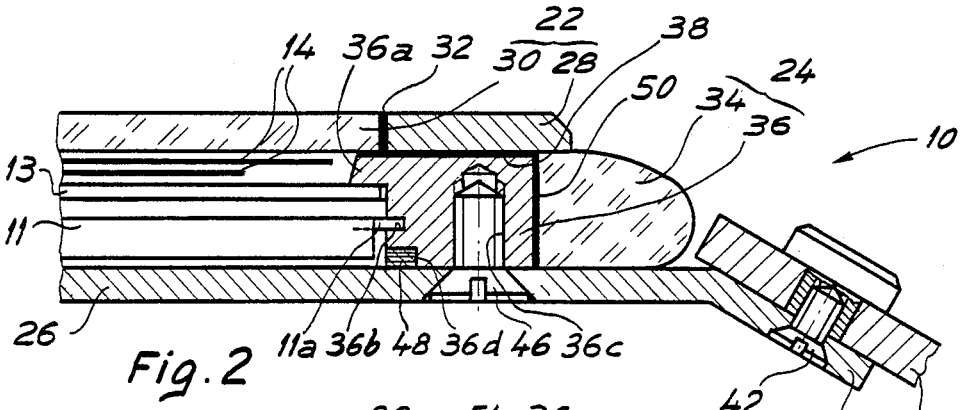

The watch shown in FIGS. 1 and 2 comprises a case 10, a movement schematically shown at 11, display means borne by the movement and including a dial 13 and hands 14, a wristlet 16 and a handsetting crown 18.

Case 10 comprises a front plate 22, a middle 24 and a back 26. Front plate 22 includes a ring 28 preferably made of hard material such as tungsten carbide or nitride, titanium or any other material having a Mohs hardness of 7 or more, and a glass 30 made of sapphire or mineral glass closing off the central opening of ring 28 in which it is secured by a bead of adhesive 32.

Middle 24 consists of a pair of concentric rings 34 and 36 having substantially the same thickness which are sandwiched between front plate 22 and back 26.

The function of inner ring 36, preferably made of brass, of plastics or of any other material readily machined by cutting tools, is to position movement 11 and dial 13 and to play a part in the assembly of the case and in keeping the case water-resistant. The movement 11 and the dial 13 are positioned by a shoulder **36*a* cooperating with the edge portion of dial 13 and by a groove 36*b* into which projects a dog-screw or lug 11a solid with movement 11. Front plate 22 is assembled on inner ring 36 by a film of adhesive 38 and back 26 is held against ring 36 by screws 46 (only one being shown in FIG. 2) which extend through the back and engage in tapped holes 36*c* in ring 36. A recess or groove 36*d* in the base or ring 36 accommodates a sealing ring 48** to provide fluidtightness between the back and the middle.

Outer ring 34, which acts as a protective and decorative element, is best made of sapphire or any other hard material, as defined above. As will be apparent from FIG. 2, front plate 22 only partly covers outer ring 34. No component is specifically provided for holding it in place. It is simply pressed between front plate 22 and back 26.

The two rings are spaced apart by a gasket 50 of flexible material, its function being to dampen shocks on the middle.

Outer ring 34 has a slot **34*a*, visible in FIG. 1, which houses crown 18. This slot provides ring 34** with a degree of resilience which reduces its sensitivity to shocks.

Back 26 has a pair of lugs 40 for securing thereto wristlet 16 with screws 42.

Figure 3:
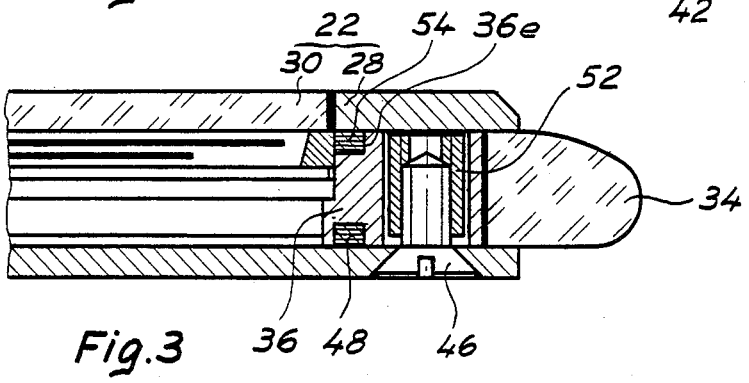
FIGS. 3 to 5 are cross-sectional views of three more cases according to the invention.

The embodiment shown in FIG. 3 differs from that of FIG. 2 in that screws 46 cooperate with tapped pegs 52 (only one being shown in FIG. 3) extending through inner ring 36 and rigidly secured as by welding to front plate 28. Inner ring 36 then has a groove **36*e* accommodating a sealing ring 54 to provide fluidtightness between front plate 22 and ring 36**.

Figure 4:
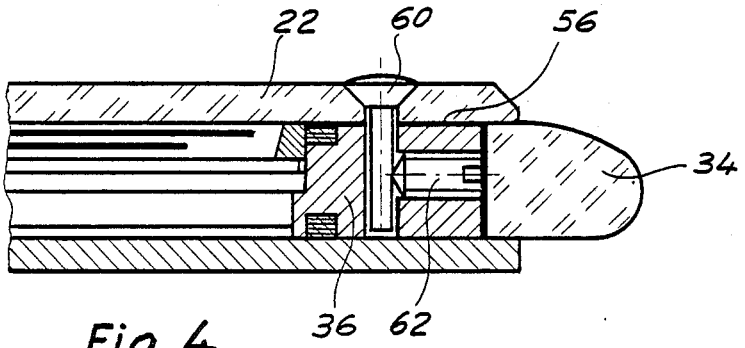

As shown in FIG. 4, front plate 22 may also be made in one piece, e.g. of sapphire. In this case, the peripheral portion of its inner surface is best provided with a metal layer 56 which masks ring 36. Plate 22 may be secured in the same way as above or with nails 60 (only one being shown in FIG. 4) engaging in holes provided in front plate 22 and ring 36. The heads of nails 60 bear on plate 22 and are blocked by screws 62 extending through tapped radial holes in ring 36.

Figure 5:
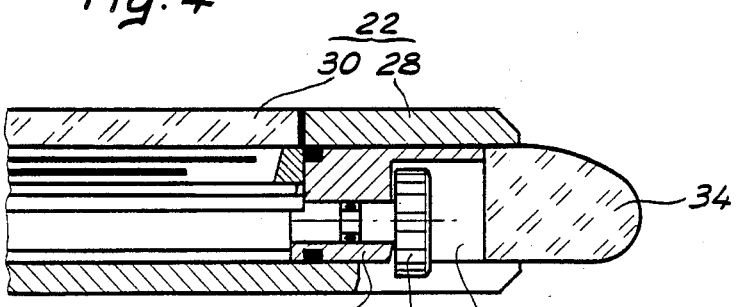

As shown in FIG. 5, hand-setting crown 18 may be hidden from view. To this end, inner ring 36 is formed with a recess 64 for accommodating crown 18, the radially outer end of recess 64 being closed off by ring 34. Back 26 however is notched opposite recess 64 to enable actuation of crown 18.

Many modifications may be made to the above described and illustrated watch cases. For instance outer ring 34 may be made of a material other than sapphire, which may or may not have the same appearance as ring 28 of front plate 22. In so doing, a variety of colours and shapes may be obtained by combining various designs of front plates 22 and of outer rings 34.

The external shapes of outer ring 34 and of front plate 22 may be freely varied whilst still retaining the same basic structure. Thus, many designs may be achieved at minimal expense.

In using sapphire for outer ring 34, an interesting aesthetic effect can be achieved, with the watch seemingly being suspended in "mid-air", the connection between the wristlet and the central part not being visible.

Besides this aesthetic effect, the manufacture of the case is simplified since all parts made of hard material are of simple shape, i.e. are easy to machine. Thus, in addition to its remarkable aesthetic appearance, the watch case can be produced relatively cheaply.

It must be understood however that the inner ring could also be made integral with the plate of the movement without departing from the scope of the invention. The problems involved in the manufacture of such an integral piece can easily be resolved by those having ordinary skill in the art.

I claim:

1. A watch case comprising a middle, a back plate, a front plate having at least a transparent, glass-acting, portion, and assembling means for assembling the middle, the back plate and the front plate, said middle including inner and outer concentric rings having opposing annular faces, said inner ring and at least a portion of said outer ring being sandwiched between said front plate and said back plate, said inner ring being adapted to provide support for a watch movement, said outer ring serving to protect the watch and to contribute to its aesthetic appearance, and said assembling means comprising screw means and nut means located radially inward from said opposing annular faces, said nut means pressing against the other of said plates and engaging said nut means within said inner ring such that said outer ring is held in place by being pressed between said front plate and said back plate.

2. A watch case as in claim 1, wherein said rings have substantially the same thickness.

3. A watch case as in claim 1, wherein the inner ring is made of a material that is machinable with cutting tools.

4. A watch case as in claim 1, wherein the outer ring and at least a portion of the front plate are made of a material having a Mohs hardness of 7 or more.

5. A watch case as in claim 4, wherein the outer ring is made of sapphire.

6. A watch case as in claim 4, wherein said front plate is made of a single piece of sapphire.

7. A watch case as in claim 1, wherein the inner ring and the front plate are stuck to one another, wherein the inner ring comprises said nut means and said screw means comprises a plurality of screws, and wherein the back plate is assembled to said inner ring with said screws which are engaged respectively in holes in said back plate.

8. A watch case as in claim 1, wherein the front plate is solid with tapped pegs comprising said nut means and extending into apertures through the inner ring, and wherein said screw means comprises a plurality of screws engaging said pegs and bearing on the back plate.

9. A watch case as in claim 1, wherein the inner ring and the front plate are assembled with nails having a head bearing on said front plate and which are blocked by screws in the inner ring.

10. A watch case as in claim 1, wherein said opposing faces of the two rings are spaced apart by a gasket made of resilient material so as to dampen shocks on the middle.

11. A watch case as in claim 1, having means for cooperating with a wristlet, integral with said back plate.

12. A watch case as in claim 1, having a hand-setting crown and wherein the outer ring is interrupted by a slot for housing said crown and providing a degree of resilience to reduce the sensitivity of said outer ring to shocks.

13. A watch case as in claim 1, having a hand-setting crown and wherein the inner ring has a recess accommodating said crown, at least a portion of said recess being closed off by said outer ring to hide said crown from view.

14. A watch case as in claim 13, wherein said back plate is notched opposite to said recess to enable actuation of said crown.

15. A watch case as in claim 1, wherein said outer ring has a substantially uniform cross-sectional shape.

16. A watch case as in claim 1, wherein said outer ring has no components, such as grooves, shoulders or holes, for holding said outer ring in place between said front plate and said back plate.

17. A watch case as in claim 1, wherein said inner ring carries seal means for providing fluidtightness from the front plate to the back plate when said outer ring is pressed therebetween.

18. A watch case as in claim 1, wherein said inner ring extends axially from adjacent the front plate to adjacent the back plate.

* * * * *